US010248047B2

(12) United States Patent
Tamura

(10) Patent No.: US 10,248,047 B2
(45) Date of Patent: Apr. 2, 2019

(54) TONER CASE INCLUDING PROJECTION OR RECESS TO IDENTIFY COLOR OF TONER STORED THEREIN AND IMAGE FORMING APPARATUS INCLUDING THE SAME, TONER KIT INCLUDING TONER CASE AND PACKAGING BOX

(71) Applicant: KYOCERA Document Solutions Inc., Osaka (JP)

(72) Inventor: Takashi Tamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/967,745

(22) Filed: May 1, 2018

(65) Prior Publication Data

US 2018/0329362 A1 Nov. 15, 2018

(30) Foreign Application Priority Data

May 15, 2017 (JP) ..... 2017-096328

(51) Int. Cl.

| | |
|---|---|
| ***G03G 15/08*** | (2006.01) |
| ***G03G 21/16*** | (2006.01) |
| ***G03G 21/18*** | (2006.01) |
| *G03G 15/00* | (2006.01) |
| *G03G 15/01* | (2006.01) |

(52) U.S. Cl.

CPC ..... *G03G 15/0863* (2013.01); *G03G 15/0875* (2013.01); *G03G 21/1676* (2013.01); *G03G 21/181* (2013.01); *G03G 15/0121* (2013.01); *G03G 15/556* (2013.01); *G03G 2215/068* (2013.01); *G03G 2215/0695* (2013.01); *G03G 2215/0875* (2013.01); *G03G 2215/0886* (2013.01); *G03G 2221/163* (2013.01)

(58) Field of Classification Search

CPC ..... G03G 15/0121; G03G 15/0863; G03G 21/1676; G03G 21/1647; G03G 21/1896; G03G 2215/0695; G03G 2215/0875; G03G 2215/0886; G03G 2221/163

USPC ..... 399/28, 262; 347/86

See application file for complete search history.

(56) References Cited

U.S. PATENT DOCUMENTS 4,611,899 A * 9/1986 Kasamura ..... G03G 15/0872 399/12
5,519,422 A * 5/1996 Thoman ..... B41J 2/1752 347/49
5,530,531 A * 6/1996 Girard ..... B41J 2/1755 222/DIG. 1
6,151,041 A * 11/2000 Bolash ..... B41J 2/17546 347/14
7,073,898 B2 * 7/2006 Amemiya ..... B41J 2/1752 347/85

(Continued)

FOREIGN PATENT DOCUMENTS

JP 2010-230899 A 10/2010

*Primary Examiner* — Robert B Beatty
(74) *Attorney, Agent, or Firm* — Studebaker & Brackett PC

(57) ABSTRACT

A toner case includes a case main body and a cover. The case main body stores a toner. The cover covers a face of the case main body at one end side in a longitudinal direction of the case main body. An inside projection or an inside recess is provided on an inner face of the cover at a position to be touchable from an outside. A number of the inside projection or the inside recess is determined based on a color of the toner stored in the case main body.

14 Claims, 12 Drawing Sheets

(56) References Cited

U.S. PATENT DOCUMENTS

| | | | | |
|---|---|---|---|---|
| 7,370,950 | B2 * | 5/2008 | Amemiya | B41J 2/17543 347/108 |
| 7,962,069 | B2 * | 6/2011 | Kurenuma | G03G 15/0872 399/258 |
| 8,095,048 | B2 | 1/2012 | Awano et al. | |
| 2006/0204249 | A1 * | 9/2006 | Sugiyama | G03G 15/0872 399/12 |
| 2013/0216243 | A1 * | 8/2013 | Kouroku | G03G 15/0189 399/12 |

* cited by examiner

TONER CASE INCLUDING PROJECTION OR RECESS TO IDENTIFY COLOR OF TONER STORED THEREIN AND IMAGE FORMING APPARATUS INCLUDING THE SAME, TONER KIT INCLUDING TONER CASE AND PACKAGING BOX

INCORPORATION BY REFERENCE

This application is based on and claims the benefit of priority from Japanese patent application No. 2017-096328 filed on May 15, 2017, which is incorporated by reference in its entirety.

BACKGROUND

The present disclosure relates to a toner case and an image forming apparatus including the same, a toner kit and an image forming apparatus including the same, a packaging box and a toner case set.

An electrographic image forming apparatus performs a developing process by supplying a toner (a developer) from a developing device to an electrostatic latent image formed on a surface of an image carrier (for example, a photosensitive drum). The toner used for such a developing process is replenished from a toner case to the developing device. The above toner case is attached to an apparatus main body of the image forming apparatus, for example, and is replaced with a new toner case when the toner inside runs short.

A replacement work for the toner case is carried out by the following processes 1. to 5., for example.

1. A worker recognizes that the toner case is used up (the toner in the toner case runs short) by information from the apparatus main body, for example.
2. The worker detaches the used toner case from the apparatus main body.
3. The worker prepares a packaging box storing a new toner case having the same color as a color of the used toner case.
4. The worker takes out the new toner case from the packaging box.
5. The worker attaches the new toner case to the apparatus main body.

SUMMARY

In accordance with an aspect of the present disclosure, a toner case includes a case main body and a cover. The case main body stores a toner. The cover covers a face of the case main body at one end side in a longitudinal direction of the case main body. An inside projection or an inside recess is provided on an inner face of the cover at a position to be touchable from an outside. A number of the inside projection or the inside recess is determined based on a color of the toner stored in the case main body.

In accordance with an aspect of the present disclosure, an image forming apparatus includes the toner case and an attachment part. To the attachment part, the toner case is attached. The attachment part includes an attachment part side projection or an attachment part side recess at a position to be touchable from an outside. A number of the attachment part side projection or the attachment part side recess is identical to the number of the inside projection or the inside recess of the toner case attached to the attachment part.

In accordance with an aspect of the present disclosure, a toner kit includes a toner case and a packaging box. The toner case stores a toner. The packaging box stores the toner case. The toner case includes a case side projection or a case side recess at a position to be touchable from an outside. A number of the case side projection or the case side recess is determined based on a color of the toner stored in the toner case. The packaging box includes a box side projection or a box side recess at a position to be touchable from an outside. A number of the box side projection or the box side recess is identical to the number of the case side projection or the case side recess of the toner case stored in the packaging box.

In accordance with an aspect of the present disclosure, an image forming apparatus includes the toner kit and an attachment part. To the attachment part, the toner case is attached. The attachment part includes an attachment part side projection or an attachment part side recess at a position to be touchable from an outside. A number of the attachment part side projection or the attachment part side recess is identical to the number of the case side projection or the case side recess of the toner case attached to the attachment part.

In accordance with an aspect of the present disclosure, a packaging box stores a toner case storing a toner. The packaging box includes a box side projection or a box side recess at a position to be touchable from an outside. A number of the box side projection or the box side recess is determined based on a color of the toner stored in the toner case.

In accordance with an aspect of the present disclosure, a toner case set includes a plurality of toner cases. Each of the toner cases includes a case main body and a cover. The case main body stores a toner of a different color. The cover covers a face of the case main body at one end side in a longitudinal direction of the case main body. An inside projection or an inside recess is provided on an inner face of the cover at a position to be touchable from an outside. A number of the inside projection or the inside recess is different depending on the color of the toner stored in the case main body.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to attached drawings, an image forming apparatus 1 according to one embodiment of the present disclosure will be described. In the following description, arrows Fr, Rr, L, R, U and Lo shown in each figure respectively indicate a front side, a rear side, a left side, a right side, an upper side and a lower side of the image forming apparatus 1.

First, an entire structure of the image forming apparatus 1 will be described. The image forming apparatus 1 is a multifunctional peripheral including multi functions, such as a printing function, a copying function and a facsimile function, for example.

Figure 1:
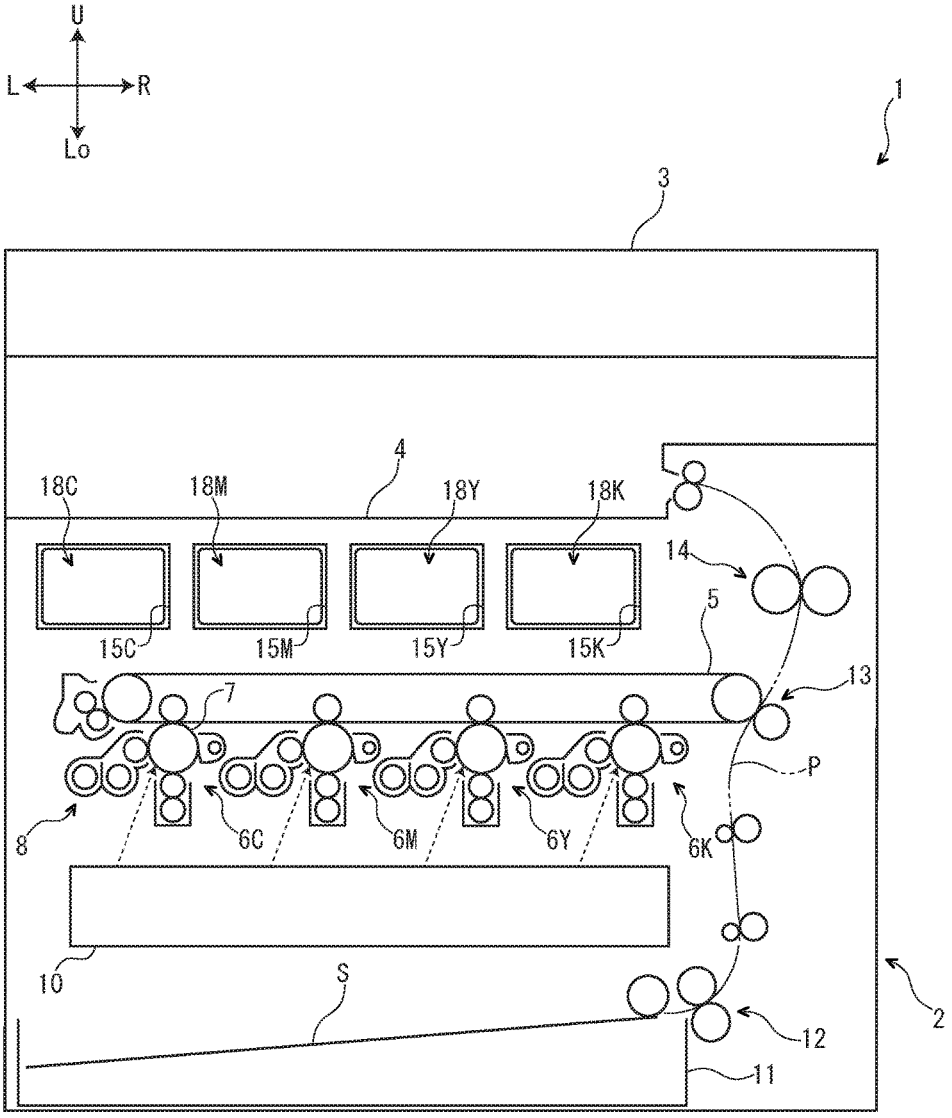
FIG. 1 is a schematic view showing an image forming apparatus according to an embodiment of the present disclosure.

As shown in FIG. 1, the image forming apparatus 1 includes a box-shaped apparatus main body 2. On an upper end portion of the apparatus main body 2, an image reading device 3 configured to read an image of a document is provided.

In an upper portion of the apparatus main body 2, an ejected sheet tray 4 is provided. In an approximate center portion of the apparatus main body 2, an intermediate transferring belt 5 and four image forming parts 6C, 6M, 6Y and 6K are stored. The four image forming parts 6C, 6M, 6Y and 6K respectively correspond to cyan, magenta, yellow and black. Each of the image forming parts 6C, 6M, 6Y and 6K includes a photosensitive drum 7 (an example of an image carrier) and a developing device 8. In a lower portion of the apparatus main body 2, an exposing device 10 is stored. In a lower end portion of the apparatus main body 2, a sheet feeding cassette 11 storing a sheet S (an example of a recording medium) is stored.

In a right side portion of the apparatus main body 2, a conveying path P for the sheet S is provided. At an upstream end of the conveying path P, a sheet feeding part 12 is provided. At a middle portion of the conveying path P, a secondary transferring part 13 is provided. At a downstream portion of the conveying path P, a fixing device 14 is provided.

In the upper portion of the apparatus main body 2, four attachment parts 15C, 15M, 15Y and 15K are provided below the ejected sheet tray 4. The attachment parts 15C, 15M, 15Y and 15K respectively correspond to cyan, magenta, yellow and black. To the attachment parts 15C, 15M, 15Y and 15K, toner containers (an example of a toner case) 18C, 18M, 18Y and 18K are detachably attached, respectively. The toner containers 18C, 18M, 18Y and 18K respectively correspond to cyan, magenta, yellow and black.

Next, an example of an operation of the image forming apparatus 1 will be described.

First, laser light (refer to a dotted line in FIG. 1) emitted from the exposing device 10 exposes the photosensitive drum 7 of each of the image forming parts 6C, 6M, 6Y and 6K to form an electrostatic latent image on the photosensitive drum 7. The electrostatic latent image is developed by the developing device 8 of each of the image forming parts 6C, 6M, 6Y and 6K. Thereby, a toner image is carried on the photosensitive drum 7 of each of the image forming parts 6C, 6M, 6Y and 6K. The toner image is primarily transferred on the intermediate transferring belt 5 from the photosensitive drum 7 of each of the image forming parts 6C, 6M, 6Y and 6K. Then, a full color toner image is formed on the intermediate transferring belt 5.

On the other hand, the sheet S fed from the sheet feeding cassette 11 by the sheet feeding part 12 is conveyed to a downstream side along the conveying path P and enters the secondary transferring part 13. At the secondary transferring part 13, the full color toner image formed on the intermediate transferring belt 5 is secondarily transferred on the sheet S. The sheet S on which the toner image is secondarily transferred is conveyed to the downstream side along the conveying path P and enters the fixing device 14. The fixing device 14 fixes the toner image on the sheet S. The sheet S on which the toner image is fixed is ejected on the ejected sheet tray 4.

Figure 2:
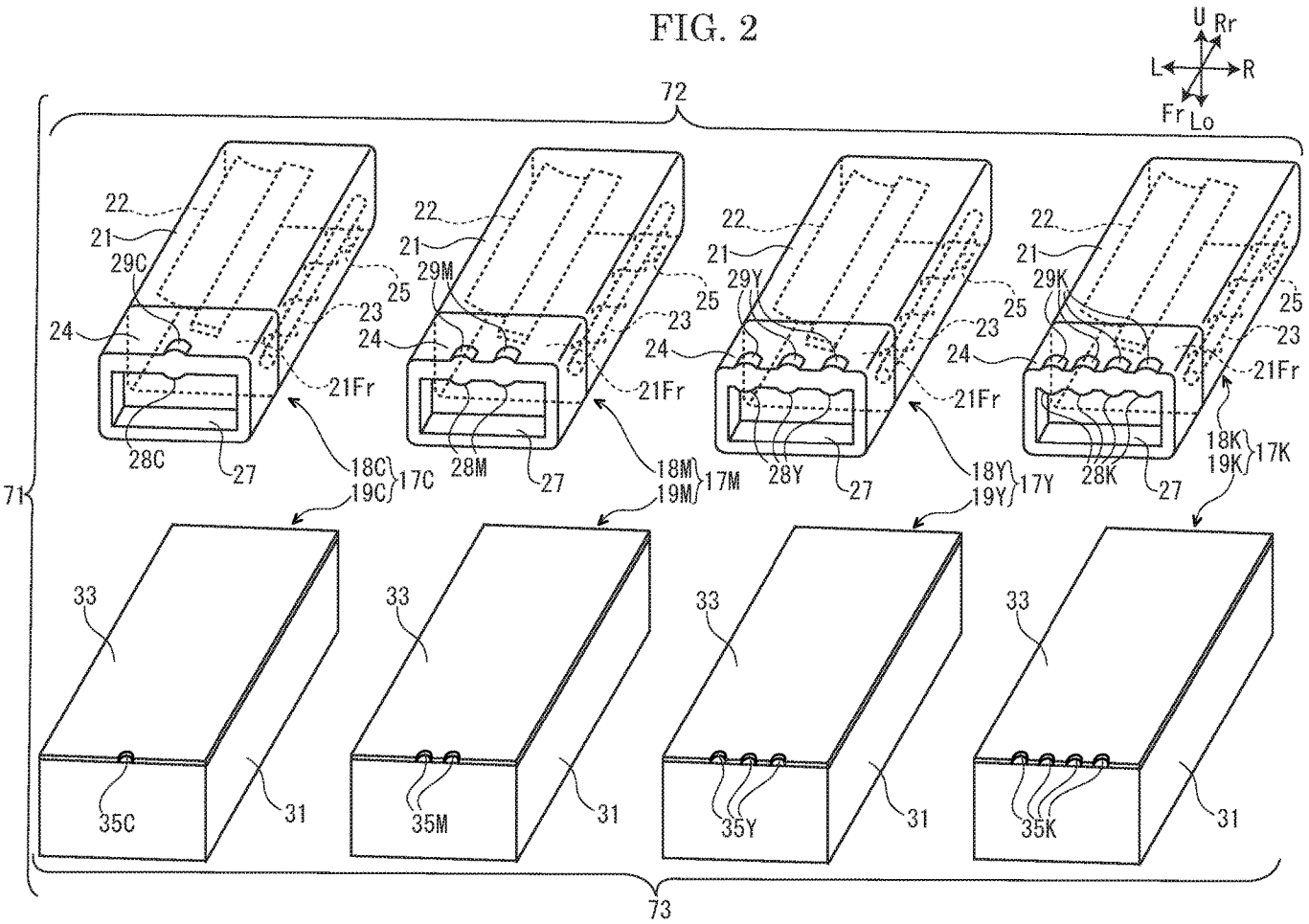
FIG. 2 is a perspective view showing four toner kits according to the embodiment of the present disclosure.

With reference to FIG. 2, the image forming apparatus 1 of the present embodiment includes four toner kits 17C, 17M, 17Y and 17K. The toner kits 17C, 17M, 17Y and 17K respectively correspond to cyan, magenta, yellow and black. Hereinafter, the four toner kits 17C, 17M, 17Y and 17K will be described in detail.

Figure 3:
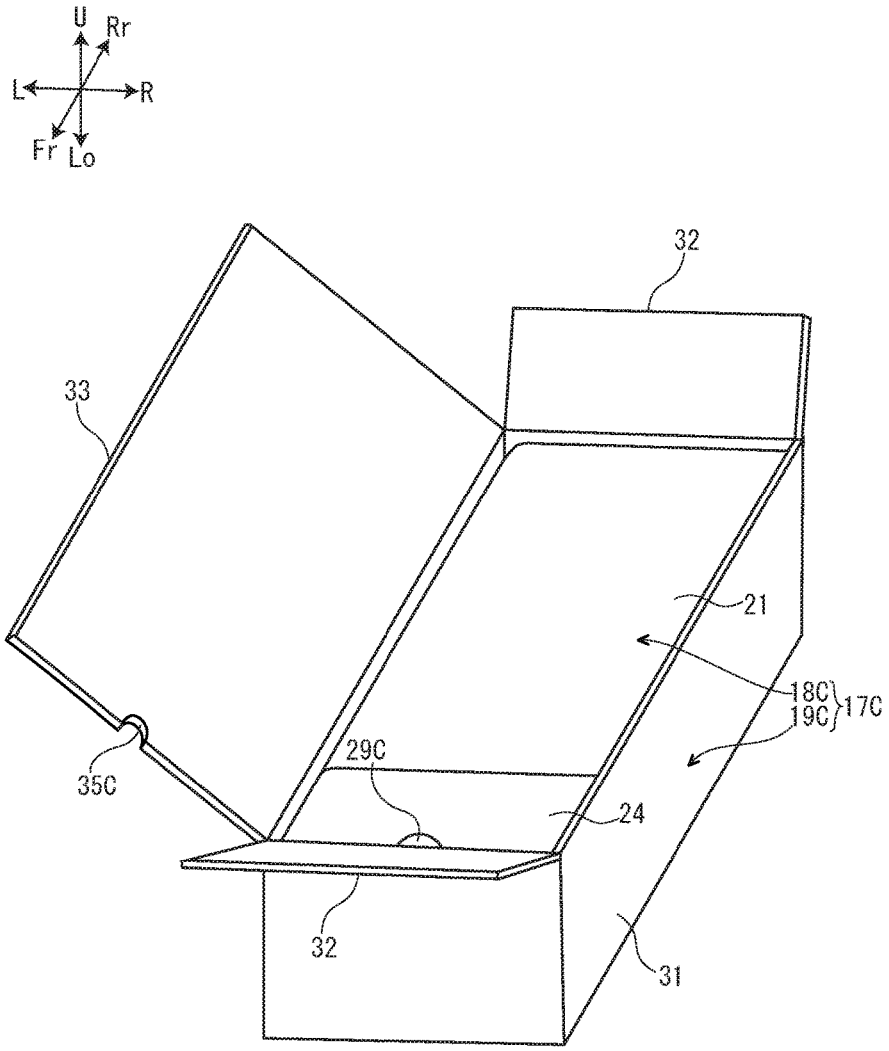
FIG. 3 is a perspective view showing the cyan toner kit according to the embodiment of the present disclosure.

With reference to FIG. 2 and FIG. 3, the toner kit 17C (the cyan toner kit) includes a toner container 18C (a cyan toner container) and a packaging box 19C (a cyan packaging box) storing the toner container 18C.

With reference to FIG. 2, the toner container 18C includes a case main body 21, an agitator 22 and a conveyer 23 which are stored in the case main body 21 and a cover 24 provided at an front side of the case main body 21.

The case main body 21 of the toner container 18C is formed in a shape elongated in the front-and-rear direction. The case main body 21 stores a cyan toner (a developer). On a bottom face of the case main body 21, a discharge port 25 through which the toner is discharged is provided.

The agitator 22 of the toner container 18C is rotatably supported by the case main body 21, and is configured to rotate so as to agitate the toner stored in the case main body 21.

The conveyer 23 of the toner container 18C is rotatably supported by the case main body 21, and is configured to rotate so as to convey the toner stored in the case main body 21 and then to discharge the toner through the discharge port 25 of the case main body 21.

The cover 24 of the toner container 18C covers a front face 21Fr of the case main body 21 (a face of the case main body 21 at one end side in the longitudinal direction of the case main body 21). At a front portion of the cover 24, a handle 27 formed in a rectangular tubular shape is provided. The handle 27 extends along the front-and-rear direction. On an upper portion of an inner face of the handle 27, one inside projection 28C (an example of a case side projection) is provided at a position to be touchable from an outside of the toner container 18C. The inside projection 28C extends along the front-and-rear direction, and is curved downward in an arc shape. On an upper portion of an outer face of the handle 27, one outside projection 29C (an example of a case side projection) is provided at a position to be touchable from the outside of the toner container 18C. The outside projection 29C extends along the front-and-rear direction, and is curved upward in an arc shape. A number of the outside projection 29C is identical to a number of the inside projection 28C. A position of the outside projection 29C in the left-and-right direction (a width direction of the case main body 21) corresponds to (is overlapped with) a position of the inside projection 28C in the left-and-right direction (the width direction of the case main body 21).

With reference to FIG. 2 and FIG. 3, the packaging box 19C is made of a corrugated board, for example. The packaging box 19C includes a box main body 31 whose upper face is opened, a pair of inner flaps 32 connected to a front upper portion and a rear upper portion of the box main body 31 and an outer flap 33 connected to a left upper portion of the box main body 31.

The outer flap 33 of the packaging box 19C covers the upper face of the box main body 31. The outer flap 33 overlaps with the pair of inner flaps 32 from the upper side. At a front edge portion of the outer flap 33, one box side recess 35C is provided at a position to be touchable from an outside. The box side recess 35C is curved rearward in an arc shape. A number of the box side recess 35C is identical to the number of each of the inside projection 28C and the outside projection 29C of the toner container 18C stored in the packaging box 19C.

With reference to FIG. 2, the toner kit 17M (the magenta toner kit) includes a toner container 18M (a magenta toner container) and a packaging box 19M (a magenta packaging box) storing the toner container 18M.

The case main body 21 of the toner container 18M stores a magenta toner. On the upper portion of the inner face of the handle 27 of the cover 24 of the toner container 18M, two inside projections 28M (an example of a case side projection) are provided at a position to be touchable from an outside of the toner container 18M. On the upper portion of the outer face of the handle 27, two outside projections 29M (an example of a case side projection) are provided at a position to be touchable from the outside of the toner container 18M. The toner container 18M has the same configuration as that of the toner container 18C other than the above configuration, and its detailed explanation is omitted.

At the front edge portion of the outer flap 33 of the packaging box 19M, two box side recesses 35M are provided at a position to be touchable from an outside. The packaging box 19M has the same configuration as that of the packaging box 19C other than the above configuration, and its detailed explanation is omitted.

The toner kit 17Y (the yellow toner kit) includes a toner container 18Y (a yellow toner container) and a packaging box 19Y (a yellow packaging box) storing the toner container 18Y.

The case main body 21 of the toner container 18Y stores a yellow toner. On the upper portion of the inner face of the handle 27 of the cover 24 of the toner container 18Y, three inside projections 28Y (an example of a case side projection) are provided at a position to be touchable from an outside of the toner container 18Y. On the upper portion of the outer face of the handle 27, three outside projections 29Y (an example of a case side projection) are provided at a position to be touchable from the outside of the toner container 18Y. The toner container 18Y has the same configuration as that of the toner container 18C other than the above configuration, and its detailed explanation is omitted.

At the front edge portion of the outer flap 33 of the packaging box 19Y, three box side recesses 35Y are provided at a position to be touchable from an outside. The packaging box 19Y has the same configuration as that of the packaging box 19C other than the above configuration, and its detailed explanation is omitted.

The toner kit 17K (the black toner kit) includes a toner container 18K (a black toner container) and a packaging box 19K (a black packaging box) storing the toner container 18K.

The case main body 21 of the toner container 18K stores a black toner. On the upper portion of the inner face of the handle 27 of the cover 24 of the toner container 18K, four inside projections 28K (an example of a case side projection) are provided at a position to be touchable from an outside of the toner container 18K. On the upper portion of the outer face of the handle 27, four outside projections 29K (an example of a case side projection) are provided at a position to be touchable from the outside of the toner container 18K. The toner container 18K has the same configuration as that of the toner container 18C other than the above configuration, and its detailed explanation is omitted.

At the front edge portion of the outer flap 33 of the packaging box 19K, four box side recesses 35K are provided at a position to be touchable from an outside. The packaging box 19K has the same configuration as that of the packaging box 19C other than the above configuration, and its detailed explanation is omitted.

Figure 4A:
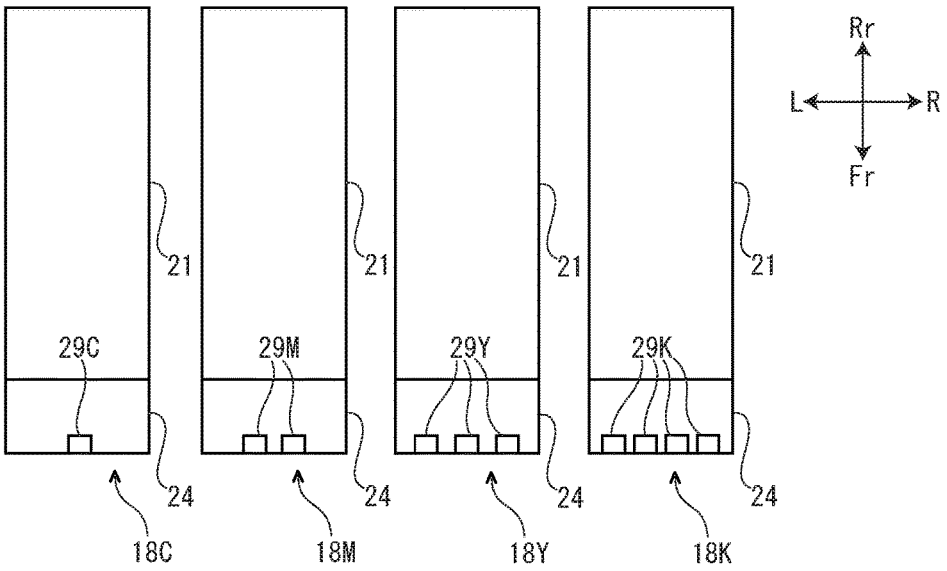
FIG. 4A is a plan view showing four toner containers shipped to a first destination, in the embodiment of the present disclosure.
Figure 4B:
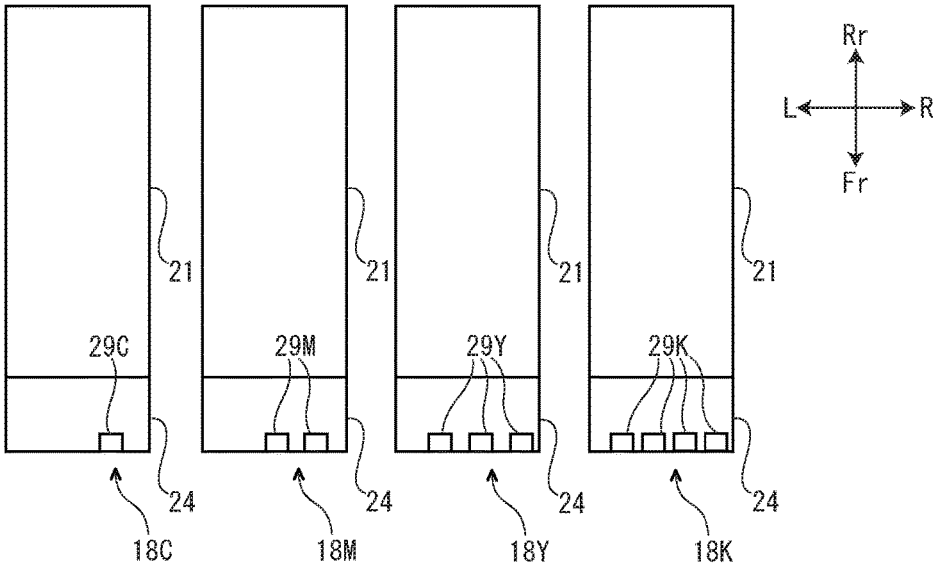
FIG. 4B is a plan view showing four toner containers shipped to a second destination, in the embodiment of the present disclosure.

The inside projection 28C and the outside projection 29C (only the outside projection 29C is shown in FIG. 4A) of the toner container 18C (refer to FIG. 4A) shipped to a first destination is respectively arranged at the left side of the inside projection 28C and the outside projection 29C (only the outside projection 29C is shown in FIG. 4B) of the toner container 18C (refer to FIG. 4B) shipped to a second destination. That is, a position of the inside projection 28C and the outside projection 29C in the left-and-right direction is different depending on the destination of the toner container 18C. In the same manner, each position of the inside projections 28M, 28Y and 28K and the outside projections 29M, 29Y and 29K in the left-and-right direction is different depending on each destination of the toner containers 18M, 18Y and 18K.

With reference to FIG. 2, the four toner kits 17C, 17M, 17Y and 17K constitute a toner kit set 71. In other words, the toner kit set 71 includes the four toner kits 17C, 17M, 17Y and 17K. The four toner containers 18C, 18M, 18Y and 18K constitute a toner container set 72 (an example of a toner case set). In other words, the toner container set 72 includes the four toner containers 18C, 18M, 18Y and 18K. The four packaging boxes 19C, 19M, 19Y and 19K constitute a packaging box set 73. In other words, the packaging box set 73 includes the four packaging boxes 19C, 19M, 19Y and 19K.

Next, the four attachment parts 15C, 15M, 15Y and 15K will be described in detail.

Figure 5:
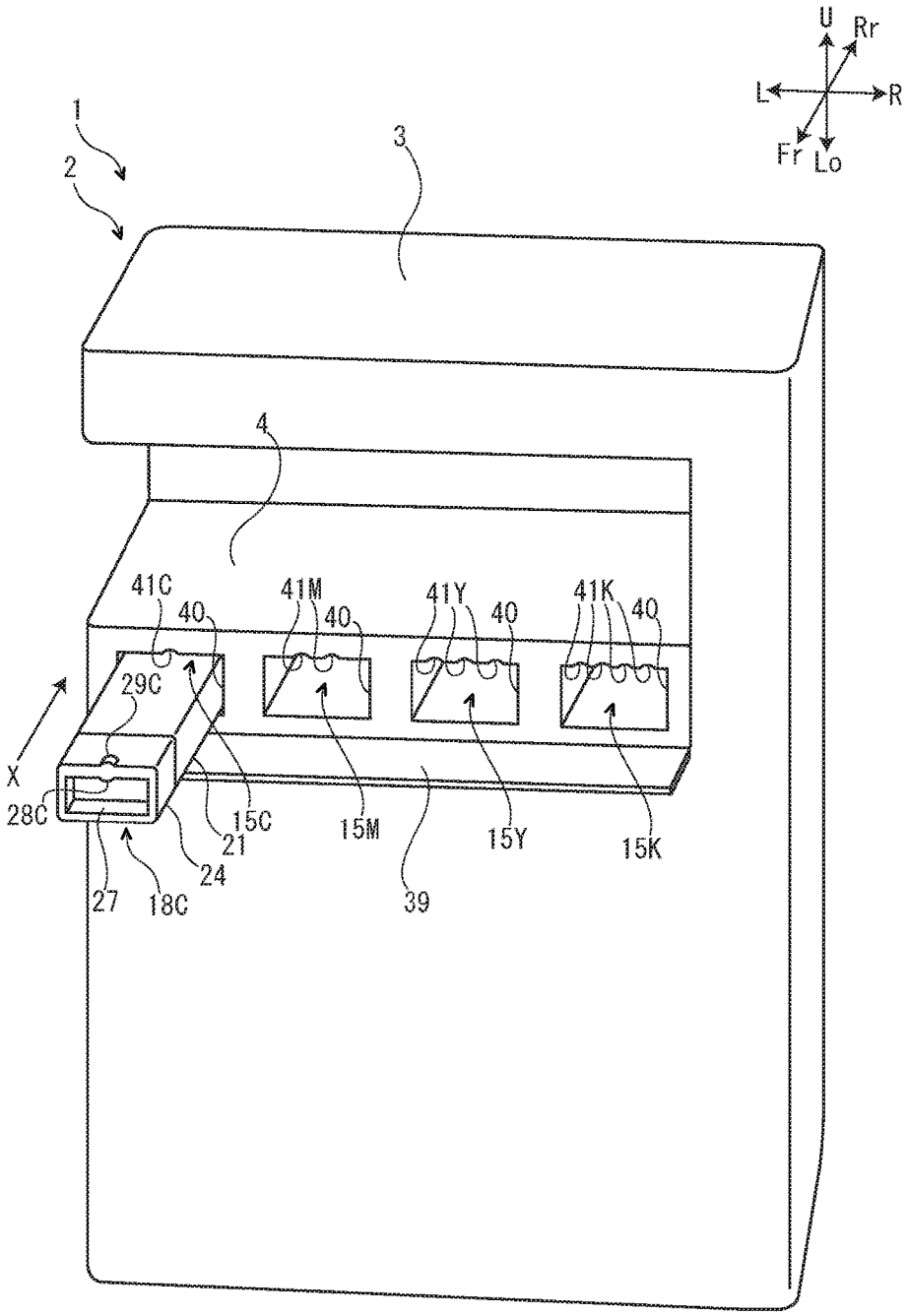
FIG. 5 is a perspective view showing an apparatus main body shipped to the first destination and the cyan toner container shipped to the first destination, in the embodiment of the present disclosure.
Figure 6:
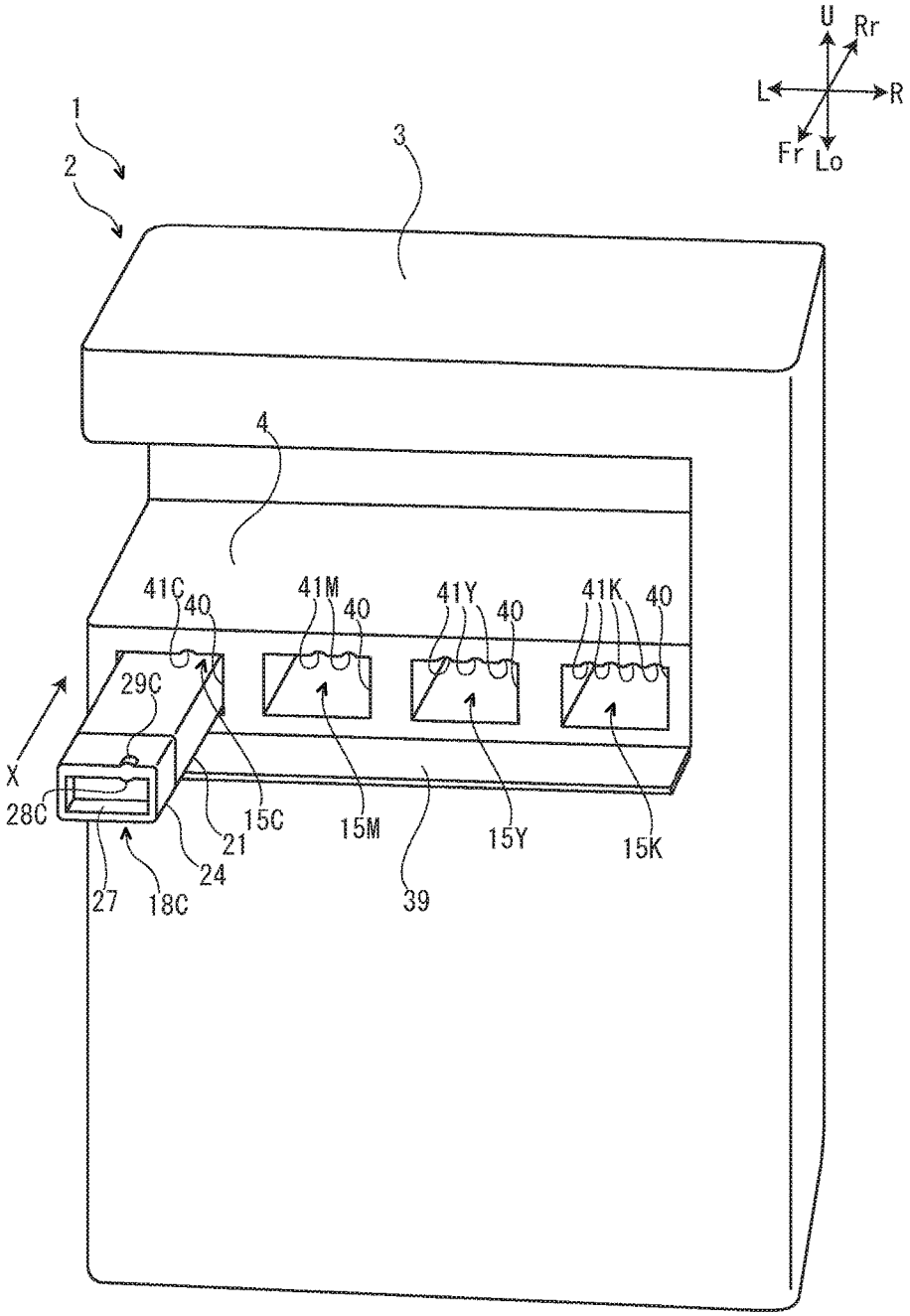
FIG. 6 is a perspective view showing the apparatus main body shipped to the second destination and the cyan toner container shipped to the second destination, in the embodiment of the present disclosure.

With reference to FIG. 5 and FIG. 6, the four attachment parts 15C, 15M, 15Y and 15K are aligned in the left-and-right direction. At the front side of the four attachment parts 15C, 15M, 15Y and 15K, an openable and closable cover member 39 is provided.

To the attachment parts 15C, 15M, 15Y and 15K, the corresponding toner containers 18C, 18M, 18Y and 18K (only the toner container 18C is shown in FIG. 5 and FIG. 6) are detachably attached along an attachment direction X from the front side to the rear side. On a front face (a near side face in the attachment direction X) of each of the attachment parts 15C, 15M, 15Y and 15K, an insertion port 40 is provided. Through the insertion ports 40, the toner containers 18C, 18M, 18Y and 18K are inserted to the corresponding attachment parts 15C, 15M, 15Y and 15K.

The attachment part 15C (the cyan attachment part) includes one attachment part side recess 41C at a position to be touchable from an outside of the attachment part 15C. The attachment part side recess 41C is provided at an upper side of the insertion port 40 of the attachment part 15C. A number of the attachment part side recess 41C is identical to the number of each of the inside projection 28C and the outside projection 29C of the toner container 18C attached to the attachment part 15C.

The attachment part 15M (the magenta attachment part) includes two attachment part side recesses 41M at a position to be touchable from an outside of the attachment part 15M. The attachment part side recesses 41M are provided at the upper side of the insertion port 40 of the attachment part 15M. A number of the attachment part side recesses 41M is identical to the number of each of the inside projections 28M and the outside projections 29M of the toner container 18M attached to the attachment part 15M.

The attachment part 15Y (the yellow attachment part) includes three attachment part side recesses 41Y at a position to be touchable from an outside of the attachment part 15Y. The attachment part side recesses 41Y are provided at the upper side of the insertion port 40 of the attachment part 15Y. A number of the attachment part side recesses 41Y is identical to the number of each of the inside projections 28Y and the outside projections 29Y of the toner container 18Y attached to the attachment part 15Y.

The attachment part 15K (the black attachment part) includes four attachment part side recesses 41K at a position to be touchable from an outside of the attachment part 15K. The attachment part side recesses 41K are provided at the upper side of the insertion port 40 of the attachment part 15K. A number of the attachment part side recesses 41K is identical to the number of each of the inside projections 28K and the outside projections 29K of the toner container 18K attached to the attachment part 15K.

The attachment part side recess 41C of the apparatus main body 2 (refer to FIG. 5) shipped to the first destination is arranged at the left side of the attachment part side recess 41C of the apparatus main body 2 (refer to FIG. 6) shipped to the second destination. That is, a position of the attachment part side recess 41C in the left-and-right direction is different depending on the destination of the apparatus main body 2. In the same manner, each position of the attachment part side recesses 41M, 41Y and 41K in the left-and-right direction is different depending on each destination of the apparatus main body 2.

Next, a control system of the image forming apparatus 1 will be described.

Figure 7:
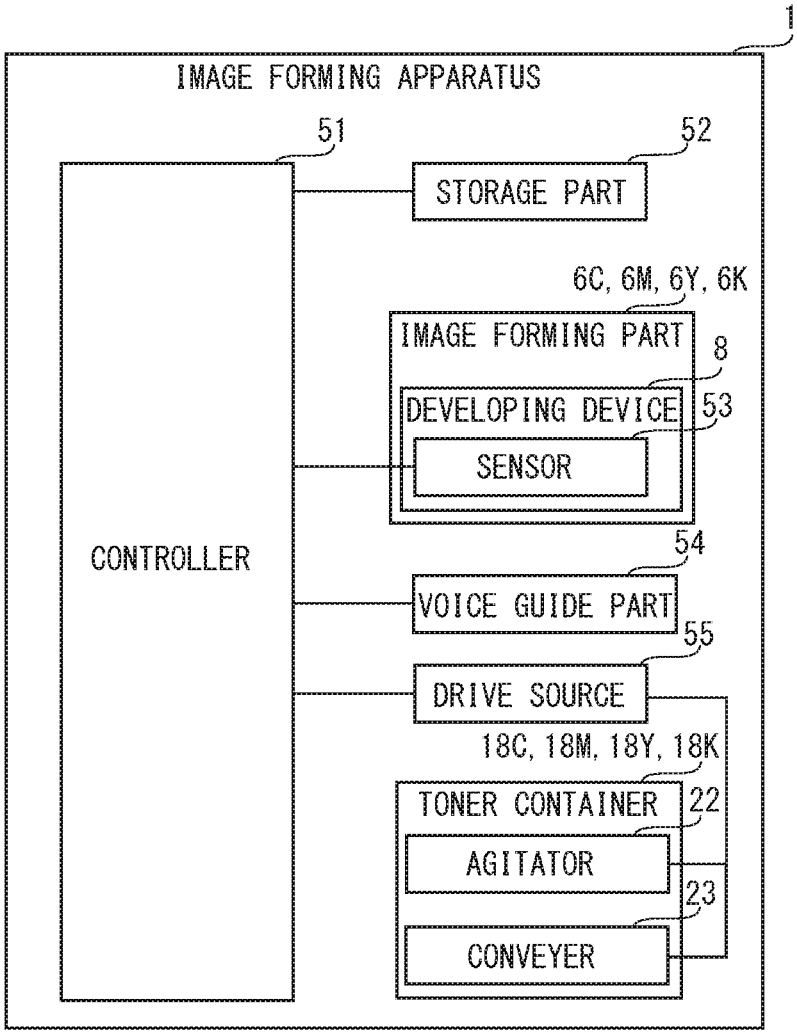
FIG. 7 is a block diagram showing a control system of the image forming apparatus according to the embodiment of the present disclosure.

With reference to FIG. 7, the image forming apparatus 1 includes a controller 51. The controller 51 is constituted by a central processing unit (CPU), for example. The controller 51 is connected to each part of the image forming apparatus 1, and controls each part of the image forming apparatus 1.

The image forming apparatus 1 includes a storage part 52. The storage part 52 is connected to the controller 51. The storage part 52 is constituted by a read only memory (ROM) and a random access memory (RAM), for example. The storage part 52 stores a program and a data for control of the image forming apparatus 1. The storage part 52 stores a threshold value Th of a toner concentration in the developing device 8 of each of the image forming parts 6C, 6M, 6Y and 6K.

The image forming apparatus 1 includes a sensor 53. The sensor 53 is connected to the controller 51. The sensor 53 is provided at the developing device 8 of each of the image forming parts 6C, 6M, 6Y and 6K, for example. The sensor 53 is constituted by a magnetic permeability sensor detecting the toner concentration in the developing device 8, for example.

The image forming apparatus 1 includes a voice guide part 54. The voice guide part 54 is connected to the controller 51. The voice guide part 54 is constituted by a speaker outputting various voice messages, for example.

The image forming apparatus 1 includes a drive source 55. The drive source 55 is connected to the controller 51. The drive source 55 is constituted by a motor, for example. The drive source 55 is connected to the agitator 22 and the conveyer 23 of each of the toner containers 18C, 18M, 18Y and 18K. When the drive source 55 is driven based on a signal output from the controller 51, the agitator 22 and the conveyer 23 of each of the toner containers 18C, 18M, 18Y and 18K are rotated, and the toner is replenished to the developing device 8 of each of the image forming parts 6C, 6M, 6Y and 6K from the corresponding toner containers 18C, 18M, 18Y and 18K. That is, the controller 51 is configured to perform a toner replenishment operation to the developing device 8.

In the image forming apparatus 1 having the above configuration, a way in which the controller 51 determines whether the toner stored in the case main body 21 of each of the toner containers 18C, 18M, 18Y and 18K is in an empty state or not will be described.

When each of the image forming parts 6C, 6M, 6Y and 6K performs the image forming operation, the sensor 53 detects the toner concentration in the developing device 8 of each of the image forming parts 6C, 6M, 6Y and 6K, and the detected result is input to the controller 51. When the toner concentration detected by the sensor 53 is the threshold value Th or larger, the controller 51 controls each of the image forming parts 6C, 6M, 6Y and 6K to per form the next image forming operation without performing the toner replenishment operation to the developing device 8. On the other hand, when the toner concentration detected by the sensor 53 is smaller than the threshold value Th, the controller 51 performs the toner replenishment operation to the developing device 8.

When the controller 51 performs the toner replenishment operation to the developing device 8, the sensor 53 detects the toner concentration in the developing device 8, and the detected result is input to the controller 51. When the toner concentration detected by the sensor 53 is increased to the threshold value Th or larger, the controller 51 determines that the toner stored in the case main body 21 of each of the toner containers 18C, 18M, 18Y and 18K is not in the empty state. In this case, the controller 51 controls each of the image forming parts 6C, 6M, 6Y and 6K to perform the next image forming operation. On the other hand, when the toner concentration detected by the sensor 53 is still smaller than the threshold value Th, the controller 51 determines that the toner stored in the case main body 21 is in the empty state.

Next, in the image forming apparatus 1 having the above configuration, a work in which a worker (especially, a visually handicapped person) replaces the toner containers 18C, 18M, 18Y and 18K with a new one will be described. For example, a work to replace the toner container 18C (the cyan toner container) with a new toner container will be described as an example.

When the controller 51 determines that the toner stored in the case main body 21 of the toner container 18C is in the empty state, the voice guide part 54 outputs a voice message including a color (cyan) of the toner in the empty state and the number (one) of each of the inside projection 28C and the outside projection 29C of the toner container 18C in which the toner stored in the case main body 21 is in the empty state. For example, the voice guide part 54 outputs the voice message, such as "the toner of cyan 1 runs short, and please replace the toner container of cyan 1 with a new one".

When such a voice message is output, the worker opens the cover member 39, recognizes that the number (one) of the attachment part side recess 41C of the attachment part 15C and the number (one) of each of the inside projection 28C and the outside projection 29C of the toner container 18C are identical, by touching, and then detaches the toner container 18C from the attachment part 15C.

Next, the worker recognizes that the number (one) of the box side recess 35C of the packaging box 19C and the number (one) of the inside projection 28C and the outside projection 29C of the toner container 18C are identical, by touching, opens the packaging box 19C, and then takes out the new toner container 18C stored in the packaging box 19C.

Then, the worker recognizes that the number (one) of each of the inside projection 28C and the outside projection 29C of the new toner container 18C and the number (one) of the attachment part side recess 41C of the attachment part 15C are identical, by touching, attaches the new toner container 18C to the attachment part 15C, and then closes the cover member 39. Thereby, the replacement work of the toner container 18C is finished.

In the present embodiment, as described above, the number of the inside projection 28C, 28M, 28Y and 28K (hereinafter, called as the inside projection 28 simply when the color is not classified) of the corresponding toner container 18C, 18M, 18Y and 18K (hereinafter, called as the toner container 18 simply when the color is not classified) is determined based on the color of the toner stored in the case main body 21 of the toner container 18, and is different depending on the color of the toner stored in the case main body 21 of the toner container 18. By applying such a configuration, it becomes possible to identify the color of the toner stored in the case main body 21 of the toner container 18 not by seeing a color and a character, but by touching. Accordingly, it becomes possible for the visually handicapped person to replace the toner container 18 with a new one easily.

Additionally, the number of the outside projections 29C, 29M, 29Y and 29K (hereinafter, called as the outside projection 29 simply when the color is not classified) of the toner container 18 is identical to the number of the inside projection 28 of the toner container 18. By applying such a configuration, it becomes possible to identify the color of the toner stored in the case main body 21 of the toner container 18 by touching easily. Accordingly, it becomes possible for the visually handicapped person to replace the toner container 18 with a new one more easily.

Additionally, the inside projection 28 of the toner container 18 is provided on the inner face of the handle 27 of the cover 24, and the outside projection 29 of the toner container 18 is provided on the outer face of the handle 27 of the cover 24. By applying such a configuration, when the worker grips the handle 27 of the cover 24, the worker is capable of recognizing the inside projection 28 and the outside projection 29 easily, and it is possible to avoid a situation that the worker spends much time on looking for the inside projection 28 and the outside projection 29.

Additionally, the number of the attachment part side recess 41C, 41M, 41Y and 41K (hereinafter, called as the attachment part side recess 41 simply when the color is not classified) of the corresponding attachment part 15C, 15M, 15Y and 15K (hereinafter, called as the attachment part 15 simply when the color is not classified) is identical to the number of each of the inside projection 28 and the outside projection 29 of the toner container 18 attached to the attachment part 15. By applying such a configuration, it becomes possible to identify the attachment part 15 to which the toner container 18 should be attached, not by seeing a color or a character, but by touching. Accordingly, it becomes possible for the visually handicapped person to replace the toner container 18 with a new one more easily.

Additionally, when the controller 51 determines that the toner stored in the case main body 21 is in the empty state, the voice guide part 54 outputs the voice message including the color of the toner in the empty state and the number of each of the inside projection 28 and the outside projection 29 of the toner container 18 in which the toner stored in the case main body 21 is in the empty state. By applying such a configuration, if the worker previously does not have information of a relationship between the number of each of the inside projection 28 and the outside projection 29 and the color of the toner, the worker is allowed to recognize the above relationship.

Additionally, the number of the box side recess 35C, 35M, 35Y and 35K (hereinafter, called as the box side recess 35 simply when the color is not classified) of the corresponding packaging box 19C, 19M, 19Y and 19K (hereinafter, called as the packaging box 19 simply when the color is not classified) is determined based on the color of the toner stored in the toner container 18 stored in the packaging box 19, is different depending on the color of the toner stored in the toner container 18 stored in the packaging box 19, and is identical to the number of each of the inside projection 28 and the outside projection 29 of the toner container 18 stored in the packaging box 19. By applying such a configuration, it becomes possible to identify the packaging box 19 storing the toner container 18 to be replaced, not by seeing a color or a character, but by touching. Accordingly, it becomes possible for the visually handicapped person to replace the toner container 18 with a new one more easily.

Figure 8A:
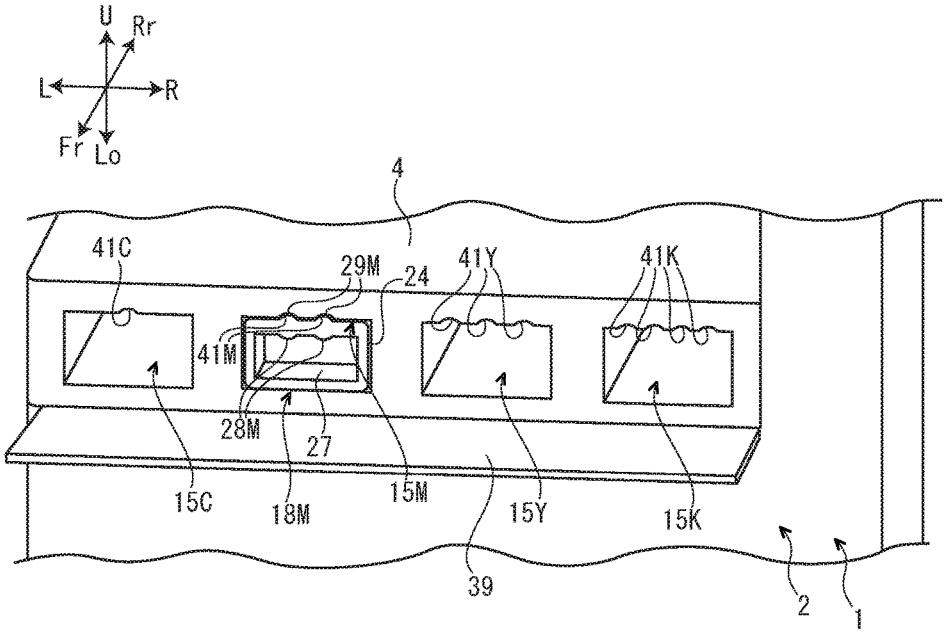
FIG. 8A is a perspective view showing a state where the magenta toner container shipped to the first destination is inserted to a magenta attachment part of the apparatus main body shipped to the first destination, in the embodiment of the present disclosure.

Additionally, as shown in FIG. 8A, when the magenta toner container 18M shipped to the first destination is inserted to the magenta attachment part 15M of the apparatus main body 2 shipped to the first destination, the outside projection 29M of the toner container 18M is engaged with the attachment part side recess 41M of the attachment part 15M, and the toner container 18M is allowed to be attached to the attachment part 15M. That is, when the color and the destination of the toner container 18 are identical to the color of the attachment part 15 and the destination of the apparatus main body 2, the outside projection 29 of the toner container 18 is engaged with the attachment part side recess 41 of the attachment part 15, and the toner container 18 is allowed to be attached to the attachment part 15.

Figure 8B:
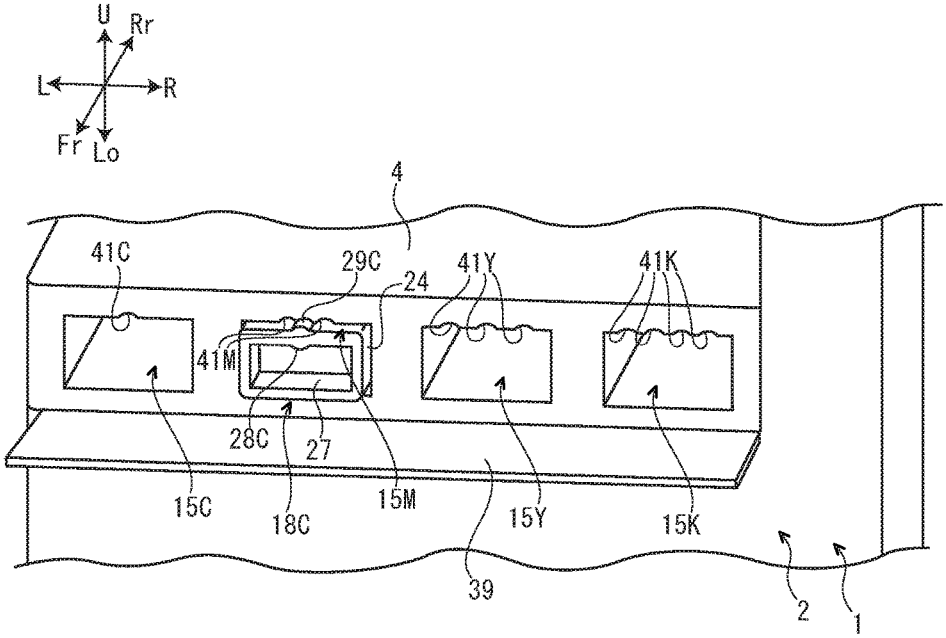
FIG. 8B is a perspective view showing a state where the cyan toner container shipped to the first destination is inserted to the magenta attachment part of the apparatus main body shipped to the first destination, in the embodiment of the present disclosure.

On the other hand, as shown in FIG. 8B, when the cyan toner container 18C shipped to the first destination is inserted to the magenta attachment part 15M of the apparatus main body 2 shipped to the first destination, the outside projection 29C of the toner container 18C is not engaged with the attachment part side recess 41M of the attachment part 15M, and the toner container 18C is prohibited from being attached to the attachment part 15M. That is, when the color of the toner container 18 is different from the color of the attachment part 15, the outside projection 29 of the toner container 18 is not engaged with the attachment part side recess 41 of the attachment part 15, and the toner container 18 is prohibited from being attached to the attachment part 15. By applying such a configuration, it becomes possible to prevent the toner container 18 from being incorrectly attached to the attachment part 15 whose color is different from the toner container 18.

Figure 8C:
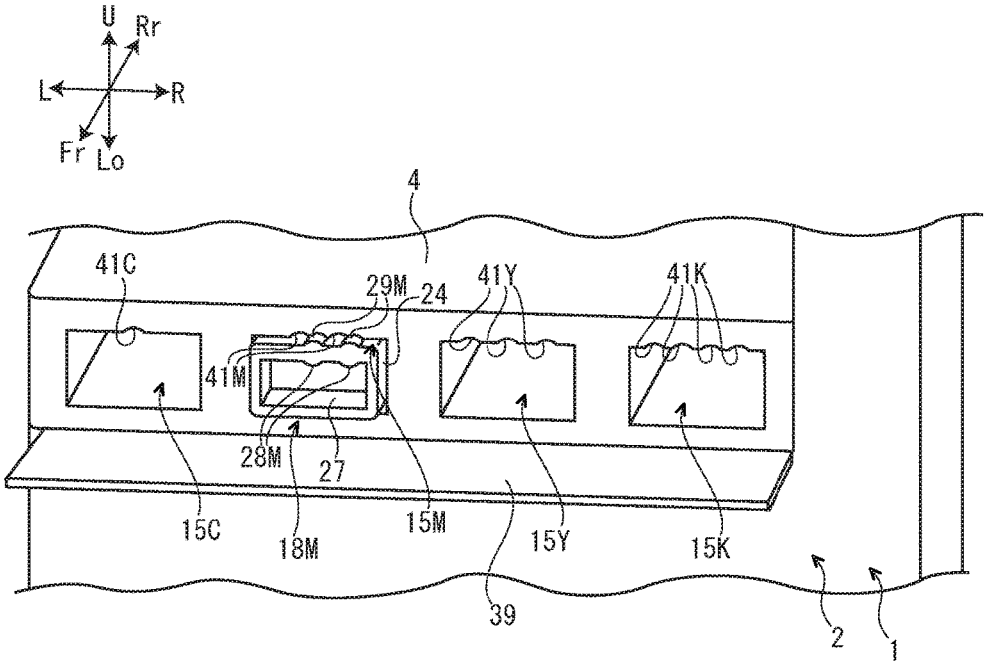
FIG. 8C is a perspective view showing a state where the magenta toner container shipped to the second destination is inserted to the magenta attachment part of the apparatus main body shipped to the first destination, in the embodiment of the present disclosure.

Additionally, as shown in FIG. 8C, when the magenta toner container 18M shipped to the second destination is inserted to the magenta attachment part 15M of the apparatus main body 2 shipped to the first destination, the outside projection 29M of the toner container 18M is not engaged with the attachment part side recess 41M of the attachment part 15M, and the toner container 18M is prohibited from being attached to the attachment part 15M. That is, when the destination of the toner container 18 is different from the destination of the apparatus main body 2, the outside projection 29 of the toner container 18 is not engaged with the attachment part side recess 41 of the attachment part 15, and the toner container 18 is prohibited from being attached to the attachment part 15. By applying such a configuration, it becomes possible to use the outside projection 29 to identify the color of the toner container 18 and the attachment part side recess 41 to identify the color of the attachment part 15 as also an incompatible shape to identify the destination. Accordingly, it becomes possible to avoid increasing of the manufacturing cost of the image forming apparatus 1 caused by adding the incompatible shape to identify the destination.

Additionally, the toner container set 72 includes the plurality of toner containers 18, each toner container 18 includes the case main body 21 storing the toner of the different color and the cover 24 covering the front face 21Fr (the face of the case main body 21 at one end side in the longitudinal direction of the case main body 21), the inside projection 28 is provided on the inner face of the cover 24 at a position to be touchable from the outside, and the number of the inside projection 28 is different depending on the color of the toner stored in the case main body 21. By applying such a configuration, it becomes possible to identify the color of the toner stored in the case main body 21 of the toner container 18 not by seeing a color or a character, but by touching. Accordingly, it becomes possible for the visually handicapped person to replace the toner container 18 with a new one more easily.

Figure 9:
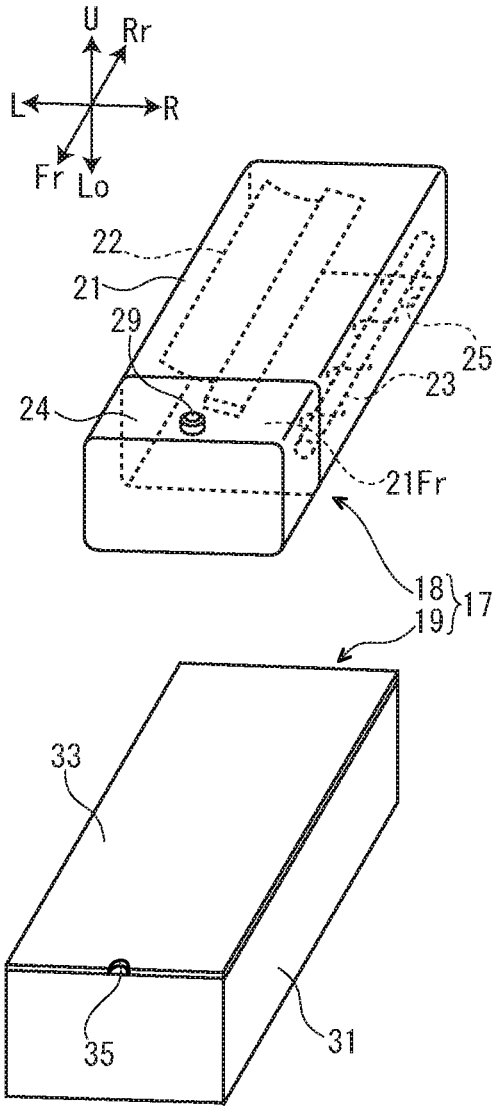
FIG. 9 is a perspective view showing the cyan toner kit according to another embodiment of the present disclosure.

In the present embodiment, the toner container 18 includes the inside projection 28 and the outside projection 29. On the other hand, in another embodiment, as shown in FIG. 9, the toner container 18 may include the outside projection 29 only. Alternatively, the toner container 18 may include the inside projection 28 only (not shown).

Figure 10:
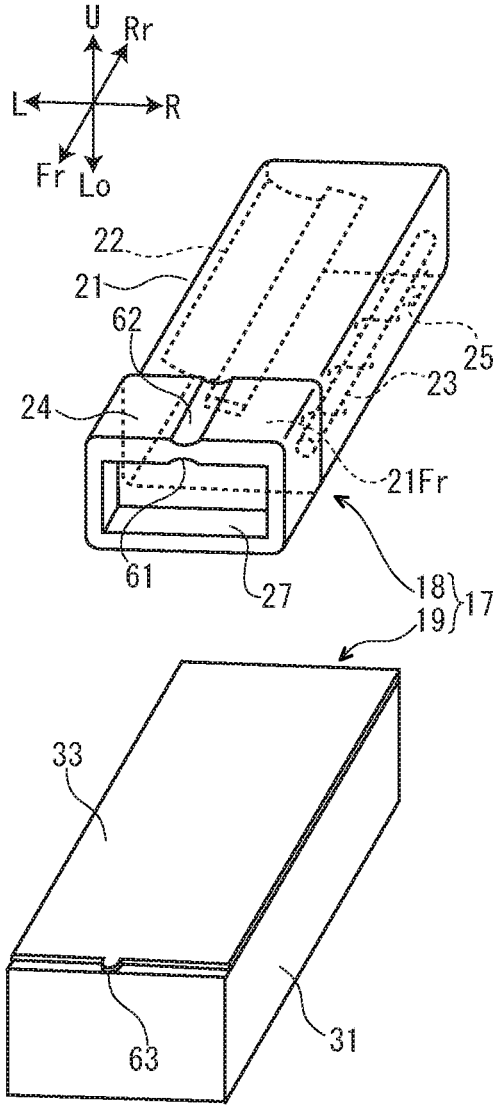
FIG. 10 is a perspective view showing the cyan toner kit according to still another embodiment of the present disclosure.
Figure 11:
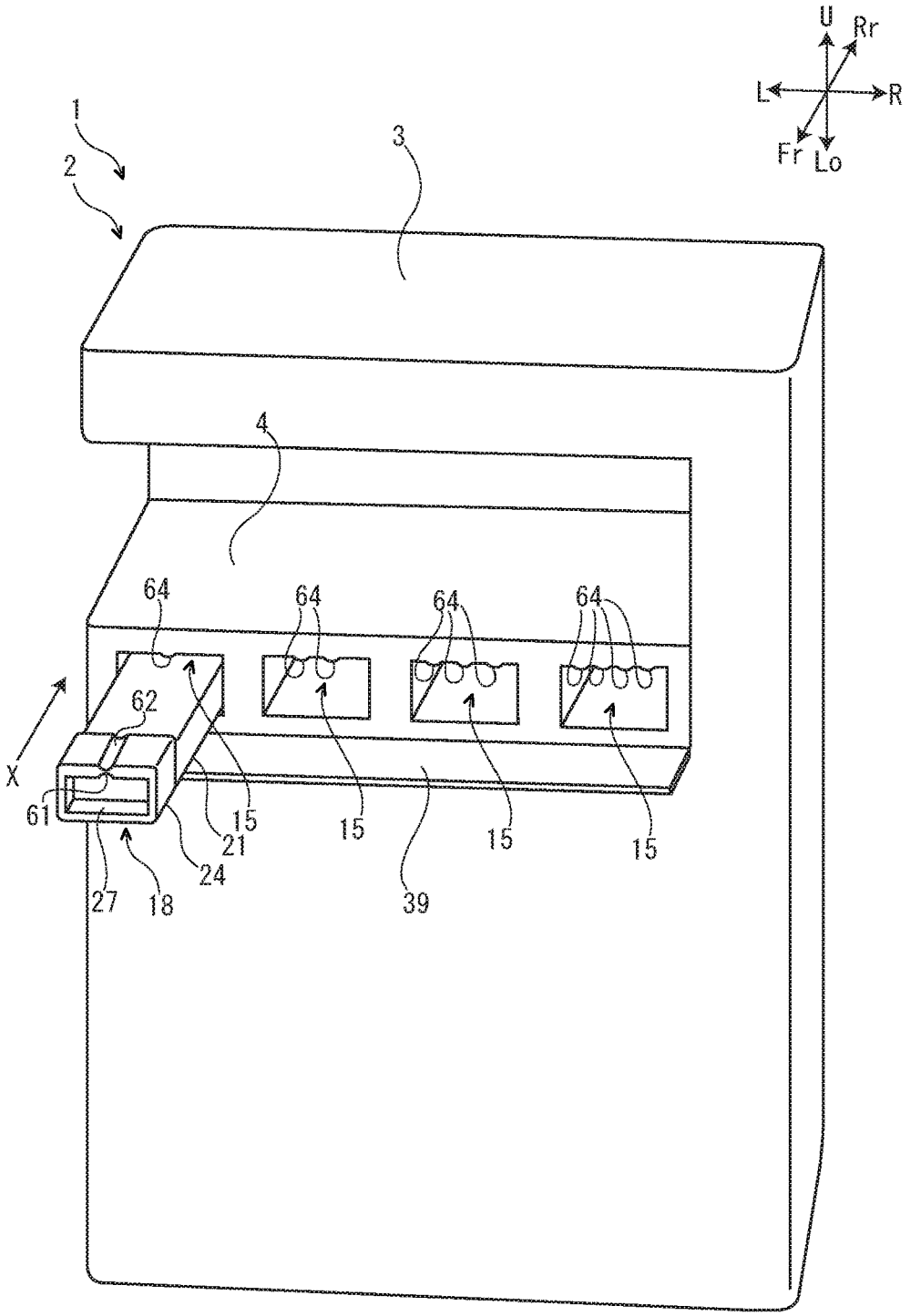
FIG. 11 is a perspective view showing the apparatus main body and the cyan toner container according to still another embodiment of the present disclosure.

In the present embodiment, the toner container 18 includes the inside projection 28. On the other hand, in still another embodiment, as shown in FIG. 10 and FIG. 11, the toner container 18 may include an inside recess 61 (an example of a case side recess) in place of the inside projection 28.

In the present embodiment, the toner container 18 includes the outside projection 29. On the other hand, in still another embodiment, as shown in FIG. 10 and FIG. 11, the toner container 18 may include an outside recess 62 (an example of a case side recess) in place of the outside projection 29.

In the present embodiment, the packaging box 19 includes the box side recess 35. On the other hand, in still another embodiment, as shown in FIG. 10, the packaging box 19 may include a box side projection 63 in place of the box side recess 35.

In the present embodiment, the attachment part 15 includes the attachment part side recess 41. On the other hand, in still another embodiment, as shown in FIG. 11, the attachment part 15 may include an attachment part side projection 64 in place of the attachment part side recess 41.

In the present embodiment, the agitator 22 and the conveyer 23 are rotated to discharge the toner stored in the case main body 21. On the other hand, in still another embodiment, the case main body 21 itself may be rotated to discharge the toner stored in the case main body 21. That is, the toner stored in the case main body 21 may be discharged by any means.

In the present embodiment, the cover 24 covers the front face 21Fr (the upstream side face of the case main body 21 in the attachment direction X) of the case main body 21. On the other hand, in still another embodiment, the cover 24 may cover a rear face (the downstream side face of the case main body 21 in the attachment direction X) of the case main body 21.

In the present embodiment, the image forming apparatus 1 is the multifunctional peripheral. On the other hand, in another embodiment, the image forming apparatus 1 may be a printer, a copying machine or a facsimile.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body storing a toner; and a cover covering a face of the case main body at one end side in a longitudinal direction of the case main body, wherein an inside projection or an inside recess is provided on an inner face of the cover at a position to be touchable from an outside, and a number of the inside projection or the inside recess is determined based on a color of the toner stored in the case main body, wherein an outside projection or an outside recess is provided on an outer face of the cover at a position corresponding to the inside projection or the inside recess, and a number of the outside projection or the outside recess is identical to the number of the inside projection or the inside recess.

2. The toner case according to claim 1, wherein a position of the outside projection or the outside recess in a width direction of the case main body is overlapped with a position of the inside projection or the inside recess in the width direction of the case main body.

3. The toner case according to claim 1,
wherein the inside projection or the inside recess extends along the longitudinal direction of the case main body, and is curved in an arc shape.

4. An image forming apparatus comprising:
the toner case according to claim 1; and
an attachment part to which the toner case is attached,
wherein the attachment part includes an attachment part side projection or an attachment part side recess at a position to be touchable from an outside, and
a number of the attachment part side projection or the attachment part side recess is identical to the number of the inside projection or the inside recess of the toner case attached to the attachment part.

5. The image forming apparatus according to claim 4, further comprising:
a controller determining whether the toner stored in the case main body is in an empty state or not; and
a voice guide part outputting a voice message including the color of the toner in the empty state and the number of the inside projection or the inside recess of the toner case where the toner stored in the case main body is in the empty state when the controller determines that the toner stored in the case main body is in the empty state.

6. An image forming apparatus comprising:
the toner case according to claim 1; and
an attachment part to which the toner case is attached,
wherein the outside projection is provided on the outer face of the cover,
the attachment part includes an attachment part side recess at a position to be touchable from an outside,
when a color of the toner case is identical to a color of the attachment part, the outside projection is engaged with the attachment part side recess and the toner case is allowed to be attached to the attachment part, and
when the color of the toner case is different from the color of the attachment part, the outside projection is not engaged with the attachment part side recess and the toner case is prohibited from being attached to the attachment part.

7. The image forming apparatus according to claim 6,
wherein a position of the outside projection is different depending on a destination of the toner case,
a position of the attachment part side recess is different depending on a destination of an apparatus main body at which the attachment part is provided,
when the destination of the toner case is identical to the destination of the apparatus main body, the outside projection is engaged with the attachment part side recess and the toner case is allowed to be attached to the attachment part, and
when the destination of the toner case is different from the destination of the apparatus main body, the outside projection is not engaged with the attachment part side recess and the toner case is prohibited from being attached to the attachment part.

8. A toner kit comprising:
the toner case according to claim 1; and
a packaging box storing the toner case.

9. An image forming apparatus comprising:
the toner kit according to claim 8; and
an attachment part to which the toner case is attached,
wherein the attachment part includes an attachment part side projection or an attachment part side recess at a position to be touchable from an outside, and
a number of the attachment part side projection or the attachment part side recess is identical to the number of the inside projection or the inside recess of the toner case attached to the attachment part.

10. A toner case set comprising a plurality of toner cases,
wherein each of the toner cases is the toner case according to claim 1.

11. A toner case comprising:
a case main body storing a toner; and
a cover covering a face of the case main body at one end side in a longitudinal direction of the case main body,
wherein an inside projection or an inside recess is provided on an inner face of the cover at a position to be touchable from an outside, and
a number of the inside projection or the inside recess is determined based on a color of the toner stored in the case main body,
wherein the cover includes a handle extending along the longitudinal direction of the case main body, and
the inside projection or the inside recess is provided on an inner face of the handle.

12. The toner case according to claim 11,
wherein the handle is formed in a rectangular tubular shape, and
the inside projection or the inside recess is provided on an upper portion of the inner face of the handle.

13. A toner case set comprising a plurality of toner cases,
wherein each of the toner cases is the toner case according to claim 11.

14. A toner kit comprising:
the toner case according to claim 11; and
a packaging box storing the toner case.

* * * * *